US006102120A

United States Patent [19]

Chen et al.

[11] Patent Number: 6,102,120

[45] **Date of Patent: *Aug. 15, 2000**

[54] ZONE ISOLATION TOOLS

[75] Inventors: Kuo-Chiang Chen; Haoshi Song, both of Sugar Land; Jack F. Lands, Jr., West Columbia, all of Tex.; Wallace E. Voreck, Sparta, N.J.; Dinesh R. Patel, Sugar Land, Tex.

[73] Assignee: Schlumberger Technology Corporation, Sugar Land, Tex.

[ * ] Notice: This patent is subject to a terminal disclaimer.

[21] Appl. No.: 09/098,280

[22] Filed: Jun. 16, 1998

Related U.S. Application Data

[63] Continuation-in-part of application No. 08/768,027, Dec. 13, 1996, Pat. No. 5,833,001.

[51] Int. Cl.[7] ..... E21B 33/13; E21B 36/00

[52] U.S. Cl. ..... 166/287; 166/57; 166/187; 166/207; 166/277; 166/288; 166/295; 166/300

[58] Field of Search ..... 166/57, 187, 206, 166/207, 277, 287, 288, 295, 300, 302

[56] References Cited

U.S. PATENT DOCUMENTS

| | | | |
|---|---|---|---|
| 2,286,075 | 6/1942 | Evans | 166/277 X |
| 3,047,065 | 7/1962 | Vincent | 166/277 |
| 3,067,819 | 12/1962 | Gore | 166/207 X |
| 3,134,442 | 5/1964 | Jennngs | 166/207 |
| 3,149,310 | 9/1964 | Loomis | 166/277 X |
| 3,175,618 | 3/1965 | Lang et al. | 166/207 X |
| 3,354,955 | 11/1967 | Berry | 166/207 X |
| 3,364,993 | 1/1968 | Skipper | 166/207 X |
| 3,477,506 | 11/1969 | Malone | 166/207 |
| 3,482,629 | 12/1969 | Suman, Jr. | 166/277 X |
| 3,935,910 | 2/1976 | Gaudy et al. | 166/288 X |
| 4,971,152 | 11/1990 | Koster et al. | 166/277 |
| 5,337,823 | 8/1994 | Nobileau | 166/277 |
| 5,456,319 | 10/1995 | Schmidt et al. | 166/373 |
| 5,613,557 | 3/1997 | Blount et al. | 166/277 |
| 5,833,001 | 11/1998 | Song et al. | 166/277 X |

OTHER PUBLICATIONS

Alexander G. Merzhanov, "Pyrotechnical Aspects of Self–Propagating High–Temperature Synthesis" (Plenary Lecture), XX International Pyrotechnics Seminar Colorado Springs (Jul. 1994), pp. PL–1 to PL–25.

Kameleshwar Upadhya, et al., "Materials for Ultrahigh Temperature Structural Applications," Dec. 1997; pp. 51–56.

*Primary Examiner*—George Suchfield
*Attorney, Agent, or Firm*—Trop, Pruner & Hu PC

[57] ABSTRACT

An apparatus and method for sealing an inner wall of a portion of a casing positioned in a well employs an inflatable sleeve having an outer surface and a conformable composite sleeve of curable composition extending around the outer surface of the inflatable sleeve. The inflatable sleeve is inflated to compress the composite sleeve against the surface of the inner casing wall. A local, activatable energy source, positioned downhole to deliver heat to the composite sleeve, is activated to cure the composite sleeve to form a hardened sleeve. The hardened sleeve presses against the inner wall of the casing portion to create a fluid seal. The embodiments shown have a number of preferred features. The local energy source includes an exothermic heat energy source for generating heat energy to cure the composite sleeve. The composite sleeve includes a mixture of resin and a curing agent, and the exothermic heat source includes thermite. The thermite includes a composition having a metal oxide and a reductant. A starter mix is positioned adjacent the exothermic heat energy source, and the starter mix is ignited to start an exothermic reaction in the heat energy source. A conformable layer extends around the composite sleeve, with the layer serving to form a seal between the composite sleeve and the inner wall of the casing portion.

48 Claims, 10 Drawing Sheets

ZONE ISOLATION TOOLS

CROSS REFERENCE TO RELATED APPLICATIONS

This application is a continuation-in-part of U.S. patent application Ser. No. 08/768,027, now U.S. Pat. No. 5,833,001, entitled "Sealing Well Casings," filed Dec. 13, 1996.

BACKGROUND

The invention relates to zone isolation tools for sealing portions of a well.

After a well has been drilled and the casing has been cemented in the well, one or more sections of the casing adjacent pay zones are perforated to allow fluid from the surrounding formation to flow into the well for production to the surface. Perforating guns are lowered into the well and the guns are fired to create openings in the casing and to extend perforations into the surrounding formation. In the well shown in FIG. 1, two perforated regions 14 and 16 in the formation are shown next to two different sections of the casing 12 in a well 10.

Contaminants (such as water or sand) are sometimes produced along with the oil and gas from the surrounding formation. In the system shown in FIG. 1, during production, fluid flows from the perforated regions 14 and 16 through perforated openings in the casing 12 into the bore 20 of the well 10. The fluid then rises up through a production tubing 18 to the surface. A packer 22 positioned near the bottom of the production tubing 18 is used to seal off well fluids from the annulus 24 between the production tubing 18 and the casing 12.

If contaminants are detected in the fluid from the production tubing 18, then a logging tool is lowered into the well 10 to determine the source of the contaminants. If, for example, the source of contaminants is the perforated region 14, then the perforated openings in the casing 12 are sealed to prevent fluid flow from the perforated region.

To seal the desired section of the casing 12, one technique typically used is referred to in the industry as a "squeeze job." First, the production tubing 18 is removed from the well. Then, the zone in the casing 12 adjacent the general area of the perforated region 14 is isolated using temporary packers. Cement is pumped down the bore 20 through a tube to the isolated zone to seal the perforated openings in the desired section of the casing 12. Drilling out of the cement is then required if production is desired from a lower payzone.

Another technique has been proposed for sealing casing sections downhole, which is described in J. L. Saltel et al., "In-Situ Polymerization of an Inflatable Sleeve to Reline Damaged Tubing and Shut-Off Perforations," Offshore Technology Conference, pp. 1–11 (May 1996). A cable carrying seven electrical conductors is used to lower an inflatable sleeve which carries a permanent sleeve (comprised of resins, fibers, and elastomers) downhole. The inflatable sleeve is pressurized to push the permanent seal against the inside surface of the casing. Electric power provided down the wireline from the surface is used to generate heat to increase the temperature of the resin for a sufficient period of time to cross link (or "cure") the resin in the permanent sleeve. The permanent sleeve is left downhole to maintain a seal over perforated sections of the casing.

The electrical energy required to cross link the resin in the system of Saltel et al. varies between 400 W/m and 1,900 W/m, depending upon the diameters of the casing. To provide the necessary electrical energy, a 1,250-volt DC supply is used at the surface to generate greater than about 2.5 amps of current through each of the seven conductors and the associated resistive elements.

SUMMARY

In general, the invention is directed to a local heat source used with zone isolation tools.

In general, in one aspect, the invention features an apparatus for sealing an inner wall of a portion of a casing positioned in a well. An inflatable sleeve has an outer surface, and a deformable composite sleeve of a curable composition extends around the outer surface of the inflatable sleeve. The inflatable sleeve is inflatable to compress the composite sleeve against the surface of the inner casing wall. A local activable heat source is positioned downhole near the composite sleeve. The energy source is activable to generate heat energy to cure the composite sleeve to form a hardened sleeve. The hardened sleeve presses against the inner wall of the casing portion to create a fluid seal.

In general, in another aspect, the invention features a method of sealing an inner wall of a portion of a casing in a well. An assembly of an inflatable sleeve, a composite, curable sleeve, and a heat source is lowered down to the casing portion using a carrying tool. The inflatable sleeve having an outer surface is positioned down the well at the portion of the casing. The composite, curable sleeve extends around the outside of the inflatable sleeve. The inflatable sleeve is inflated to compress the composite sleeve against the surface of the inner casing wall. A local heat source is activated to cure the composite sleeve to form a hardened sleeve. The hardened sleeve presses against the inner wall of the casing portion to create a fluid seal.

In general, in another aspect, the invention features a downhole tool having a composite layer of a curable composition, and a exothermic heat energy source activated to generate heat to cure the composite layer.

Other features will become apparent from the following description and from the claims.

DETAILED DESCRIPTION

To seal perforations in casing positioned in a well, a zone isolation tool can be used. In one embodiment, the zone isolation tool carries a sealing sleeve that includes an inner inflatable sleeve and an outer permanent sleeve (containing, for example, an epoxy layer having a mixture of resin and a curing agent, and a sealing film around the epoxy layer). The tool is lowered downhole to a desired section of the casing. Once properly positioned downhole, the inflatable sleeve is inflated to compress the permanent sleeve against the inner surface of the casing. Using a local source of heat energy lowered downhole with the sealing sleeve in the zone isolation tool, the permanent sleeve is then heat cured under compression to form a hardened epoxy sleeve.

In one embodiment, the local heat energy source can include a self-sustaining, gasless exothermic pyrotechnic energy source, which may include, for example, thermite. Other types of compounds that can be used in the local heat energy source include compounds which produce gasless exothermic reactions. If thermite is used, an exothermic reaction is started in the thermite to create a sufficient amount of heat energy to cure the epoxy in the permanent sleeve. The permanent sleeve, after the epoxy material has cured, stays fixed to the inner surface of the casing section, and the inflatable sleeve is deflated and detached from the permanent sleeve to allow the tool to be pulled out. In this manner, a casing seal can be created without the need for a high power electrical energy source located at the surface and means to conduct that energy downhole.

Figure 1:
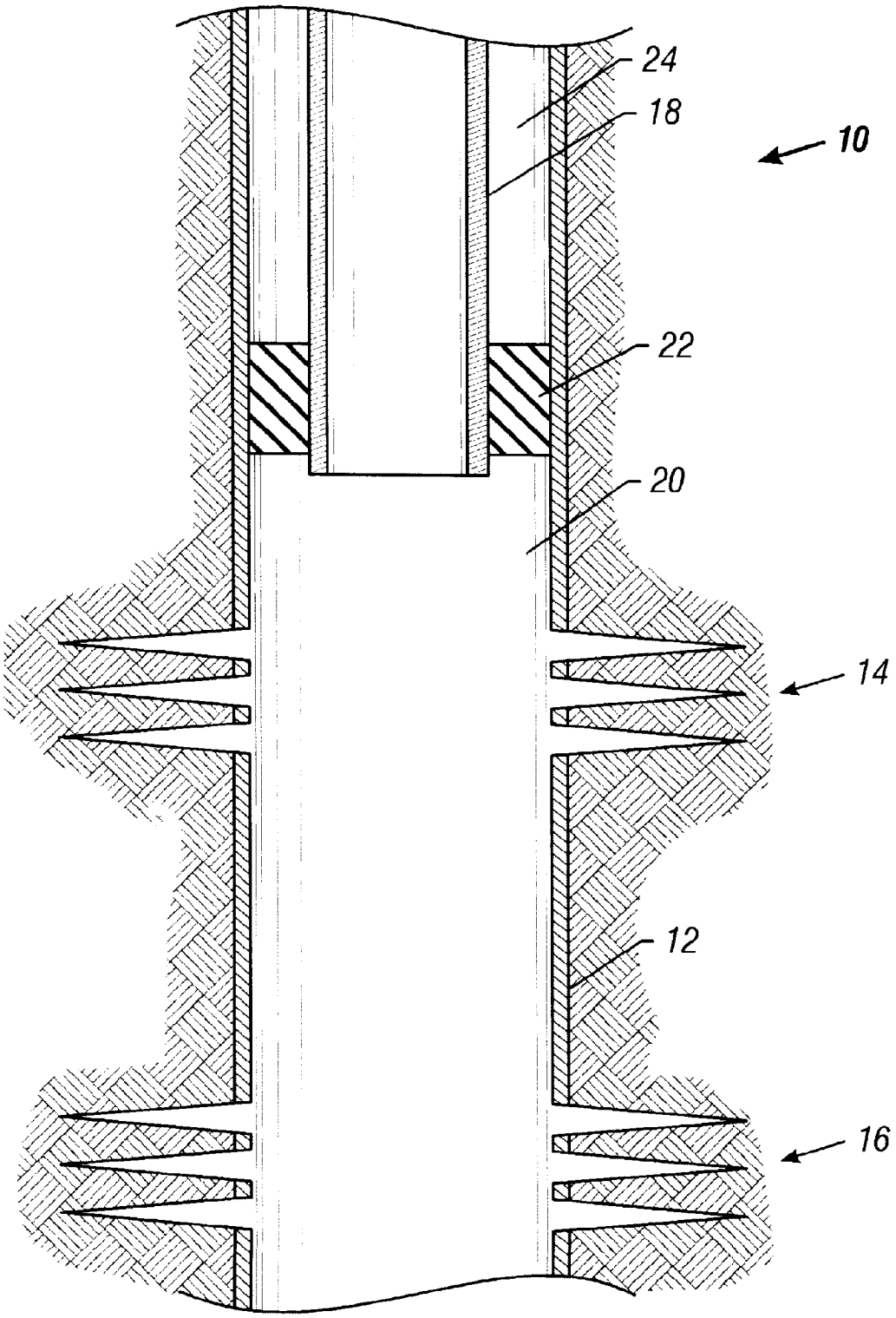
FIG. 1 (Prior Art)
FIG. 1 is a diagram of a casing having perforated portions.
Figure 2:
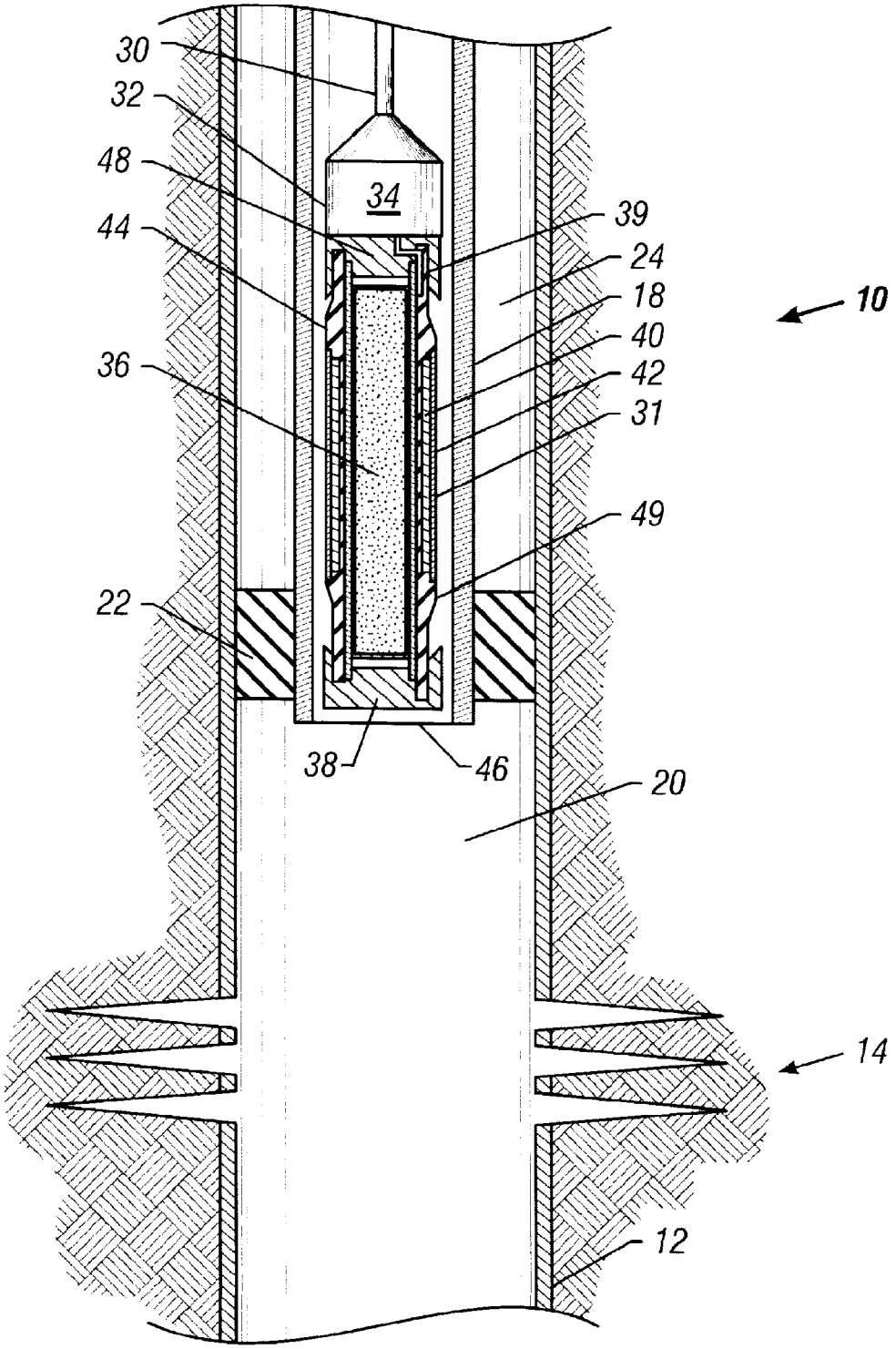
FIG. 2 is a diagram of a zone isolation tool according to an embodiment of the invention for carrying a sealing sleeve down a production tubing located in a casing.

Referring to FIG. 2, a zone isolation tool 32 according to an embodiment of the invention that carries a sealing sleeve 31 is lowered down a production tubing 18 into the bore 20 of the well 10. As shown in FIG. 2, and in greater detail in FIGS. 3 and 4, the zone isolation tool 32 includes a tool head 34 attached to a wire line or coiled tubing 30, which extends up to the surface. The tool head 34 is attached to the tool housing 48, which holds the sealing sleeve 31. The tool housing 48 includes an upper metal cap 39, a lower metal cap 38, and an energy source housing 49, which can be made of steel, for example. The energy source housing 49 is attached to the upper and lower retaining caps 39 and 38 with threads (not shown). The energy source housing 49 and caps 38 and 39 form part of an energy source housing assembly 43.

The sealing sleeve 31 is supported at the lower end of the tool 32 by the lower support metal cap 38 and at the upper end by the upper support metal cap 39. A local heat energy source 36, which can include thermite or some other exothermic pyrotechnic energy source, is positioned approximately along the center of the tool housing 48 inside the energy source housing 49, and enclosed on the top and bottom by the upper and lower caps 39 and 38, respectively.

The sealing sleeve 31 includes a generally tubular, inflatable bladder 44 (such as an elastic bladder formed, e.g., of heat resistant elastomer such as silicone rubber), which is shown in its initial, deflated state in FIG. 2. A thin elastomer film or sheet 42 is stretched around the middle section of the bladder 44. A permanent sleeve 40 (which can include epoxy that is a mixture initially in paste form of resin and a curing agent) is inserted in the region between the bladder 44 and the film 42. The combination of the epoxy sleeve 40 and the film 42 forms the permanent sleeve. Alternatively, a cylindrical layer of reinforcing materials, such as fibers or fabrics, could be used with the epoxy layer 40 to increase the strength of the permanent sleeve.

In one exemplary composition, the epoxy layer 40 is 100 parts resin and 28 parts curing agent (by weight). The resin is initially in liquid form. The curing agent can be, for example, the Ancamine™ agent (which is modified polyamine in powder form) from Air Products & Chemicals, Inc. Once mixed, the resin and curing agent form a paste material that can be pumped into the region between the bladder 44 and the film 42. The bladder 44 includes an epoxy fill port (not shown) and a vacuum port (not shown). The region is first evacuated through the vacuum port and then the epoxy layer is pumped into the region between the bladder 44 and film 42 through the epoxy fill port.

Different curing agents are available which cause the epoxy layer to cure at different temperatures. Because of varying downhole temperatures (which depend on such factors as the depth and pressure of the well), the flexibility to choose different curing temperatures is important. The range of minimum curing temperature can be between 100° C. and 130° C.

Figure 3:
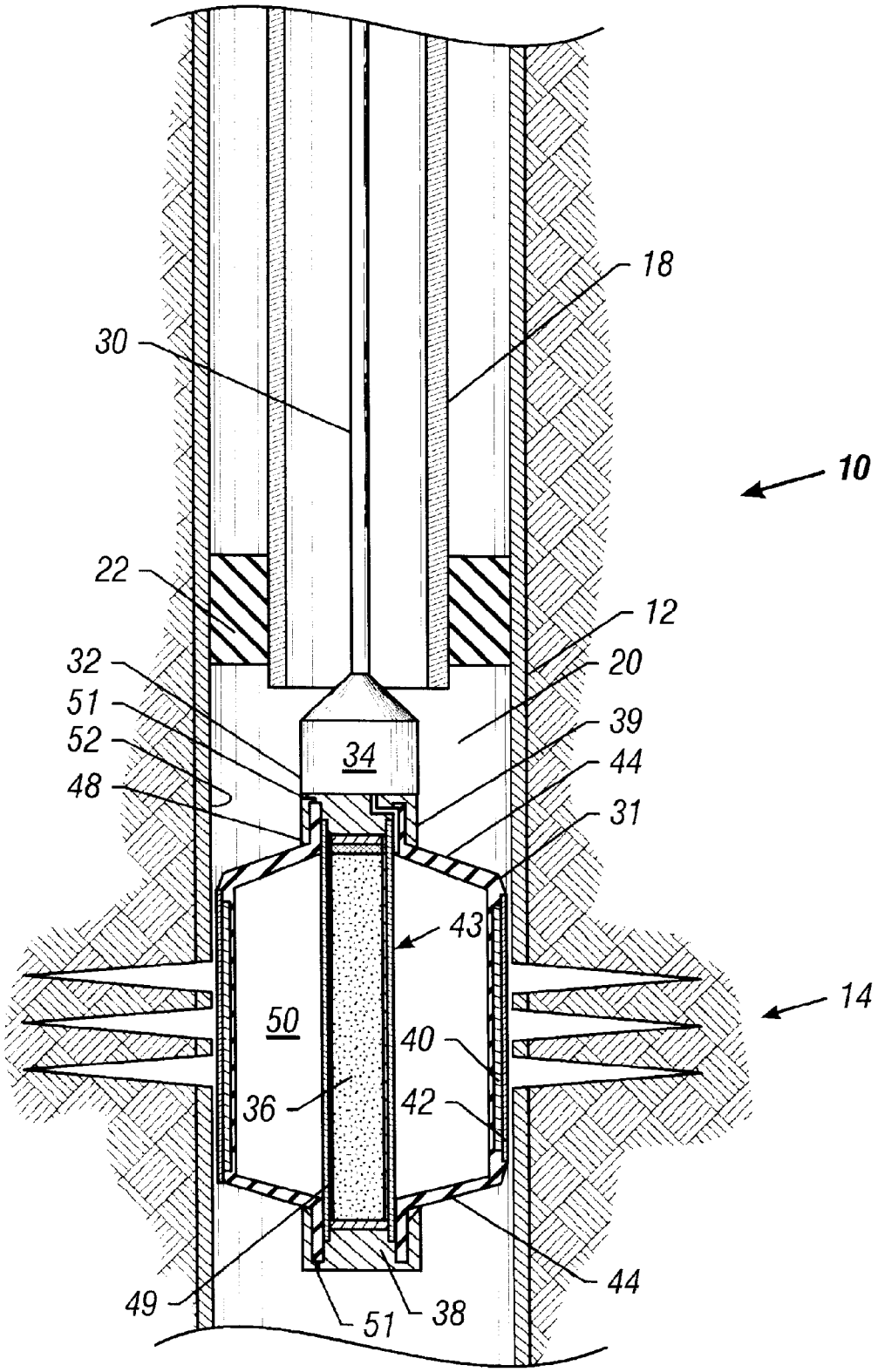
FIGS. 3 and 4 are diagrams of the sealing sleeve of FIG. 2 being positioned next to perforated openings in the casing and being inflated to press the sealing sleeve against the inner wall of the casing.

Referring to FIG. 3, the zone isolation tool 32 is shown positioned next to the portion of the casing 12 which is to be sealed using the sealing sleeve 31. Once the sealing sleeve 31 is properly positioned, a pump located in the tool head 34 is activated (from the surface) to inflate the elastomer bladder 44 by pumping fluid (e.g., gas, water, or surrounding well fluid) through line 60 (FIG. 4) into the space 50 in the bladder 44. The inflation of the bladder 44 pushes the permanent sleeve (made up of the epoxy sleeve 40 and the elastomer film 42) against the inner wall 52 of the casing 12. The local heat energy source 36 remains fixed in position by the metal tube 49, the lower cap 38, and the upper cap 39.

Once the zone isolation tool is inflated to isolate the upper and lower portions of the well 10, the pressure below the tool may rise higher than the pressure above the tool. If the pressure difference is too large, the zone isolation tool may be pushed out of position.

To equalize the pressure in the upper and lower portions of the well 10, one or more thorough-holes 51 can be created in the zone isolation tool to allow fluid communication between the upper and lower well portions. The through-hole 51 can be created through the wall of the bladder 44. By allowing such fluid flow, pressure build up beneath the zone isolation tool 32 is reduced.

Figure 4:
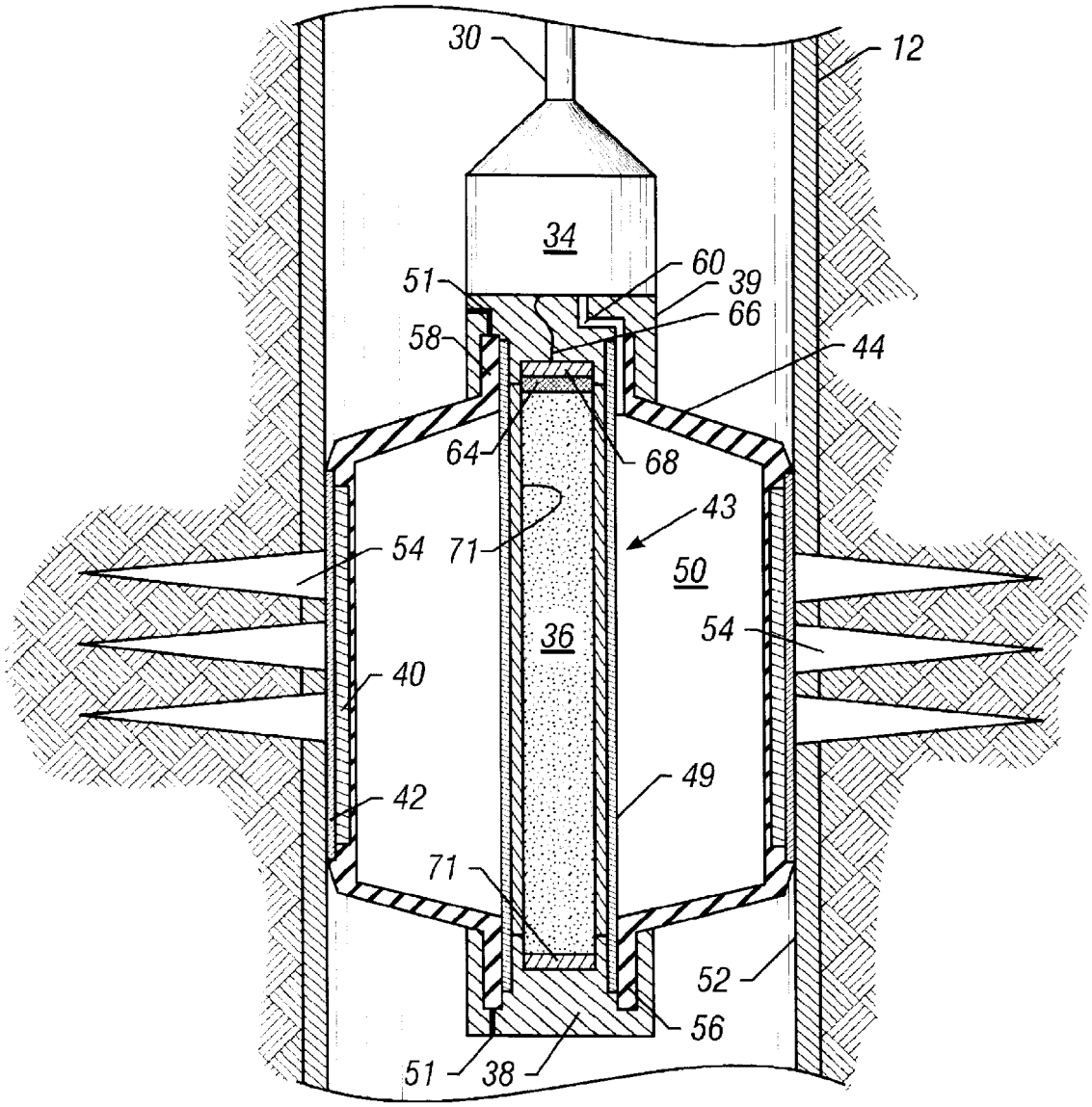

Referring to FIG. 4, the section of the zone isolation tool 32 carrying the sealing sleeve 31 is shown in greater detail. The elastomer bladder 44 is shown in its inflated state pushing the permanent sleeve against the inner wall 52 of the casing section containing perforated openings 54. The elastomer bladder 44 is fitted between an upper slot 58 in the upper support cap 39 and a lower slot 56 in the lower support cap 38. The pump in the tool head 34 pumps fluid into the space 50 in the bladder 44 through a fluid charge and discharge line 60 to inflate the bladder.

If the system is used with a wireline, then commands to activate the pump can be electrical signals. If, on the other hand, the system is used with coiled tubing, pressure pulse signals can be used, with a pressure pulse decoder located in the tool head to sense the pressure pulse signals and to activate the pump if appropriate signals are received. Other signal communications techniques can also be used.

A starter mix layer 64 overlays and is adjacent the top surface of the local energy source 36. A firing resistor 68 is positioned inside the starter mix layer 64, and is connected by a wire 66 to an electrical source (not shown) in the tool head 34. The electrical source is switched on by an operator on the surface to fire the firing resistor 68, which in turn fires the starter mix 64. The electrical source can be activated by an electrical signal through a wireline or pressure pulse signals if coiled tubing is used.

The starter mix 64 can be any composition which can be ignited with the firing resistor 68, such as a composition having a mixture of barium oxide ($BaO_2$) and magnesium (Mg). One exemplary starter mix contains 9% (by weight) of Mg and 91% of $BaO_2$. After the starter mix 64 is ignited, a self-sustainable, pyrotechnic reaction is initiated in the compound used in the local energy source 36, which releases a sufficient amount of heat energy to cause the compound to react. If thermite is used in the local heat source 36, the thermite mixture will react, melt, and become a mixture of molten metal and reductant oxide. Generally, if the local energy source 36 includes thermite the exothermic reaction for thermite is expressed by Eq. 1:

$$MeO+R \rightarrow Me+RO+\Delta H \quad \text{(Eq. 1)}$$

in which Me stands for a metal, R stands for a reductant, O stands for oxygen, and ΔH is the heat released. This kind of thermite is a gasless mixture, i.e., it does not generate gases during the exothermic reaction. This avoids problems associated with pressure build up downhole if gases are produced.

In addition to the gasless characteristic, other characteristics make thermite feasible as a thermal energy source for downhole applications. The chemical reactions of thermite start at elevated temperatures. The exothermic reaction of thermite converts chemical energy to a large amount of thermal energy. Once started, the exothermic reaction of thermite can sustain itself.

More generally, other gasless, self-sustainable, exothermic reactions can be expressed by Eq. 2A.

$$A_{solid}^{T_{in}}+B_{solid}^{T_{in}} \rightarrow A_{solid}^{T_m}+B_{solid}^{T_m} \rightarrow C_{solid}+\Delta H \quad \text{(Eq. 2A)}$$

in which $A_{solid}$ can be a metal in solid form, $B_{solid}$ can be a non-metal in solid form, $T_{in}$ is the initial temperature of reactants, $T_m$ is the maximum combustion temperature, and $C_{solid}$ is the final product after the reaction.

A even more generalized representation of a gasless, exothermic reaction is as follows:

$$A_{solid}^{T_{in}}+B_{solid}^{T_{in}}+\ldots \rightarrow P_{solid}^{T_f}+Q_{solid}^{T_f}+\ldots+\Delta H \quad \text{(Eq. 2B)}$$

where $P_{solid}$ and $Q_{solid}$ are products in solid form and $T_f$ is the final temperature (ambient temperature) of products.

Examples of the metal $A_{solid}$ that can be used include titanium (Ti), zirconium (Zr), hafnium (Hf), vanadium (V), niobium (Nb), tantalum (Ta), and other elements. Examples of the non-metal $B_{solid}$ that can be used include boron (B), carbon (C), silicon (Si), and aluminum (Al). Elements are selected based on their maximum combustion temperature, ability to reliably sustain the reaction, and other considerations (such as the ability to contain the reaction and the difficulty or ease of initiating the reaction).

Two challenges are raised in the use of exothermic pyrotechnic energy sources to produce heat for curing the permanent sleeve of the zone isolation tool. The high temperatures associated with exothermic reactions can cause packaging of the energy source to be difficult. In addition, the reaction inside the local energy source container can cause chemical reactions. For example, reaction of thermite produces a highly oxidizing environment.

The typical ignition temperatures of most thermite reactions are above 600° C. Once the exothermic reaction is started, the temperature of most thermite reactions are in the order of 3000° C., which can melt and/or oxidize most structural materials that can be used to build a container for the thermite. A popular material used downhole in a well is steel, which is relatively inexpensive and has good mechanical properties.

A thermite mixture that has a relatively low reaction temperature such that it can be contained within a steel housing is a mixture that contains $Fe_2O_3$, CuO, and Si. One exemplary mixture is 44% (by weight) of $Fe_2O_3$, 38% of CuO, and 18% of Si. The exothermic reaction of this mixture is basically a combination of two reactions, and the formula for the reaction is expressed by Eq. 3.

$$(2Fe_2O_3+3Si)\times 1+(2CuO+Si)\times 1.75 \rightarrow (3SiO_2+4Fe)\times 1+(SiO_2+2Cu)\times 1.75+\Delta H \quad \text{(Eq. 3)}$$

Using Si as fuel in the thermite mixture results in lower reaction temperatures than other reductants, such as Al, Mg, and Ca. Because of the low reaction temperature of the ($2Fe_2O_3$+3Si) reaction, it can be contained in a steel housing. To counteract this low reaction temperature, CuO is added to provide the (2CuO+Si) reaction to increase the reaction temperature and energy density. Adding CuO to the thermite mixture allows for a more reliable exothermic reaction of the thermite.

Since the thermite mixture that contains $Fe_2O_3$, CuO, and Si produces an exothermic reaction that is the combination of two reactions, secondary reactions may be produced that generate intermediate products that lower the thermal energy that is actually released. Thus, the efficiency of the exothermic reaction of that thermite mixture can be reduced.

An exothermic reaction produces a theoretical energy density $\Delta h_{theor}$. The actual energy density released $\Delta h_{real}$ is some percentage of $\Delta h_{theor}$. The thermite mixture containing $Fe_2O_3$, Si, and CuO will be referred to in this application as the "baseline thermite" and the energy density $\Delta h_{real}$ of this thermite reaction will be referred to as the "baseline heat" for purposes of comparison to other thermite reactions.

For higher energy densities, "single-reaction" thermites or other combinations of single-reaction thermites may be used. As discussed above, thermite is a mixture of a metal oxide and a reductant. Example candidates for reductants include Si, Al, Mg, Ti, and Ca, and example metal oxides include $Fe_2O_3$, CuO, CoO, $Co_3O_4$, NiO, $Ni_2O_3$, and $PbO_2$. It is contemplated that other thermite mixtures can also be used provided they have certain characteristics: sufficient energy density, gasless reaction, and ability to self sustain reactions.

Some thermite reactions are expressed below in Eqs. 4–7. If the thermite mixture includes iron oxide and aluminum, the exothermic reaction is expressed by Eq. 4.

$$Fe_2O_3+2Al \rightarrow 2Fe+Al_2O_3+\Delta H. \quad \text{(Eq. 4)}$$

If the mixture contains copper oxide and aluminum, the exothermic reaction is expressed by Eq. 5.

$$2CuO+Al \rightarrow 3Cu+Al_2O_3+\Delta H. \quad \text{(Eq. 5)}$$

If the mixture contains iron oxide and silicon, the exothermic reaction is expressed by Eq. 6.

$$2Fe_2O_3+3Si \rightarrow 4Fe+3SiO_2+\Delta H \quad \text{(Eq. 6)}$$

If the mixture contains copper oxide and silicon, the exothermic reaction is expressed by Eq. 7.

$$2CuO+Si \rightarrow 3Cu+SiO_2+\Delta H \quad \text{(Eq. 7)}$$

In Eqs. 4 and 5, Al is used as the reductant. The theoretical energy density $\Delta h_{theor}$ for the exothermic reaction of Eq. 5 is higher than the theoretical energy density for the reaction of Eq. 6 since the (CuO+Al) reaction provides a greater heat density than the ($Fe_2O_3$+Al) reaction. Other metal oxides such as CoO, $Co_3O_4$, NiO in the thermite mixture and having Al as a reductant can generate energy densities having values between the energy densities of the reactions of Eqs. 4 and 5. Thermite mixtures with $Ni_2O_3$ and $PbO_2$ as oxides can generate larger energy densities than (CuO+Al).

Similarly, in Eqs. 6 and 7, Si is used as the reductant. The thermite mixture containing copper oxide in Eq. 7 produces a higher theoretical energy density than the mixture containing iron oxide in Eq. 6.

To achieve the target of a reliable self-sustaining exothermic reaction and suppression of gas vapors during the reaction, the exothermic reactions expressed by Eqs. 4–7 can be combined. For example, the combination of the exothermic reactions of Eqs. 4 and 5 having a proportion of (1:1.75) produces the baseline thermite reaction of Eq. 3. Other example combinations of the reactions expressed in Eqs. 4–7 are also shown in the table below (column 1 shows the baseline thermite reaction and columns 2–10 show other possible example combinations):

| Themite Mixture | 1 | 2 | 3 | 4 | 5 | 6 | 7 | 8 | 9 | 10 |
|---|---|---|---|---|---|---|---|---|---|---|
| $2Fe_2O_3$ + 3Si | 1 | 1 | 1 | 4 | 1 | 1 | 0 | 0 | 0 | 0 |
| $Fe_2O_3$ + 2Al | 0 | 0 | 2 | 1 | 1 | 2 | 1 | 2 | 1 | 1 |
| 2CuO + Si | 1.75 | 3 | 0 | 12 | 1 | 1 | 0 | 0 | 0 | 0 |
| 3CuO + 2Al | 0 | 0 | 0 | 1 | 1 | 2 | 0 | 1 | 1 | 2 |
| $Fe_2O_3$ (w %) | 44 | 33 | 77 | 33 | 44 | 40 | 75 | 44 | 32 | 20 |
| CuO (w %) | 38 | 49 | 0 | 49 | 36 | 40 | 0 | 33 | 47 | 60 |
| Si (w %) | 18 | 18 | 10 | 15 | 10 | 7 | 0 | 0 | 0 | 0 |
| Al (w %) | 0 | 0 | 13 | 3 | 10 | 13 | 25 | 23 | 21 | 20 |

A steel housing can survive an exothermic reaction of only up to a predetermined energy density. Above that the steel housing may melt or burn. Thus, if steel housing is desired, one option according to an embodiment of the invention is to use an energy source with a sufficiently high power density but low reaction temperature, such as the baseline thermite of Eq. 2. Another option is to use a heat resistant material in the container for the energy source that has better thermal and chemical resistance than steel.

Possible thermal and chemical resistant materials that can be used to make containers for high reaction temperature energy sources, such as thermite, include ceramics (which has the properties of high melting point, inert reactivity with oxygen, and high thermal conductivity). Possible ceramics include alumina ($Al_2O_3$), zirconia ($ZrO_2$), and silicon nitride ($Si_3N_4$). Because ceramics have a tendency to shatter, a more reliable container can be built using steel housing for structural purposes and a ceramic tube positioned inside the steel housing as a heat resistant liner to prevent contact of the reacting thermite to the steel housing. Zirconia and silicon nitride liners have higher thermal shock resistance than alumina. Silicon nitride liners have the best thermal shock resistance.

Another heat and chemical resistant material includes carbon/graphite products. One example carbon composite ($C^3$16PC and FiberForm, from Fiber Material Inc.) has a maximum service temperature of about 2800° C. Another example carbon/graphite material that can be used is the DURACAST® DC-20 superfine grain graphite (from UCAR Carbon Inc.). The superfine grain graphite has the further advantages of low permeability, high thermal conductivity, good thermal and chemical resistance, superior thermal shock resistance to ceramics, and lower cost than some of the other materials. Graphite tubes used as heat resistant liners in a steel housing can survive a themite exothermic reaction better than can a ceramic liner. However, both types of liners provide acceptable characteristics.

Figure 8A:
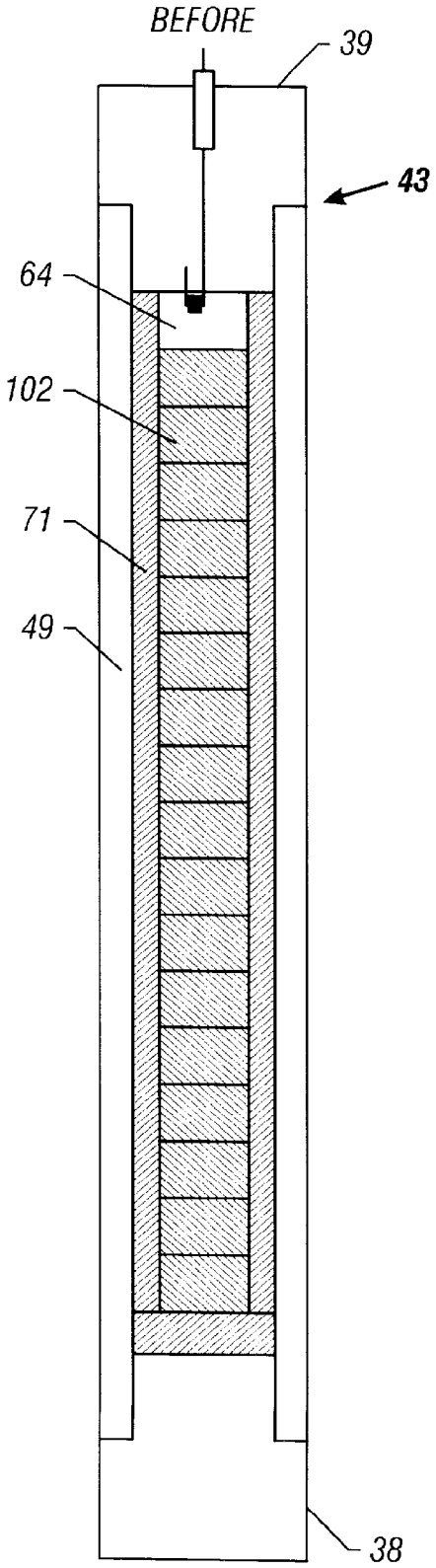
FIGS. 8A and 8B are diagrams of a zone isolation tool having a housing assembly for the energy source according to an embodiment of the invention.
Figure 8B:
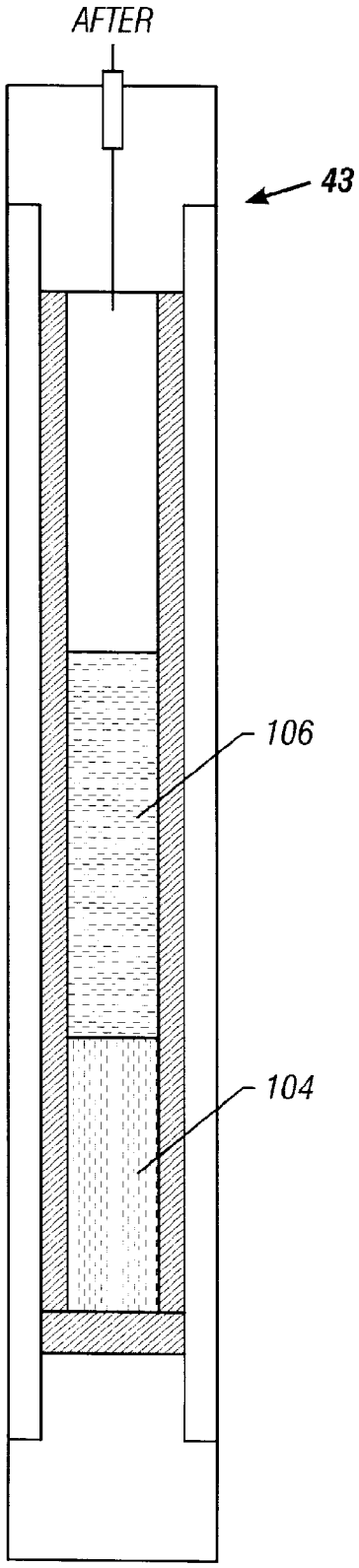

Referring to FIG. 8A, in one embodiment, cylindrical thermite pellets 102 are placed in the energy source housing assembly 43. The pellets 102 fill up the entire cavity inside a heat and chemical resistant liner in the form of a tube 71 that is made of a composite containing, for example, graphite or ceramics. The tube 71 is placed inside the metal or other suitable strong material housing 49.

Figure 7:
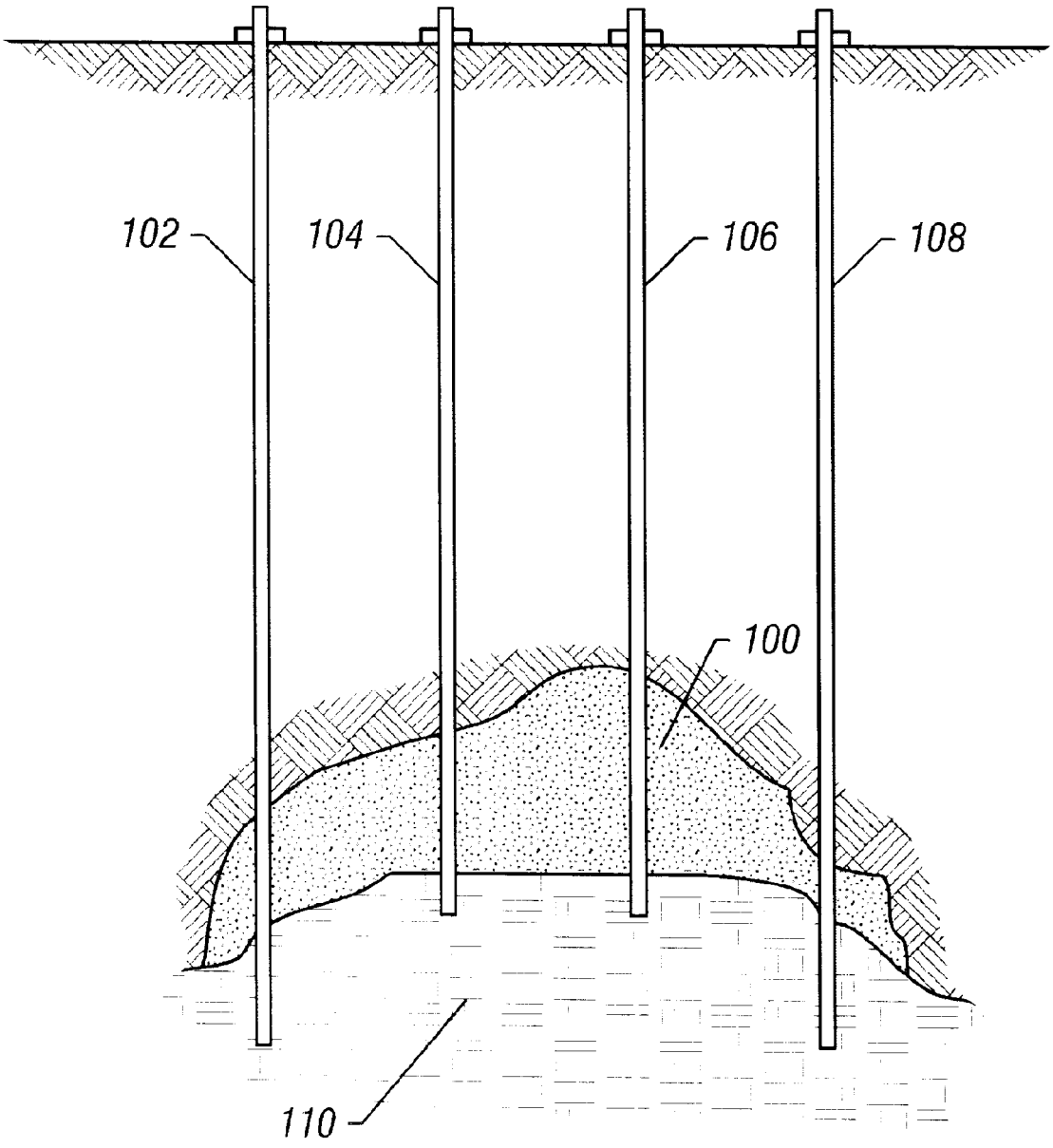
FIG. 7 is a diagram of multiple wells drilled through a formation to illustrate how the sealing sleeve can be used to modify the injection profile of a pay zone.

The pellets 102 contain thermite in powder form that is compressed. However, even using a hydraulic press, the density that can be achieved for the thermite is about 70%, which is almost the highest value of compression that can be reached if the particles of thermite are not deformed. Referring further to FIG. 7B, once the thermite melts during an exothermic reaction, the occupied volume of the products becomes smaller than the original volume of the pellets. The melted products flow to the lower portion of the housing due to gravity. Thus, during the reaction, the heat generation is concentrated in the 70% or so lower portion of the container. The melted metal drops to the bottom of the liner 71 to form a layer 104 while the metal oxide forming a layer 106 (which has a lower density than metal) floats on top of the metal layer 104. Because the energy from the thermite reaction is concentrated at the lower portion of the thermite housing the energy dissipation is not uniform along the entire length of the housing. In addition, a hot spot close to the interface of the metal oxide layer 106 and the metal layer 104 occurs. The concentrated heat may be enough to burn through the protective liner 71.

Figure 9A:
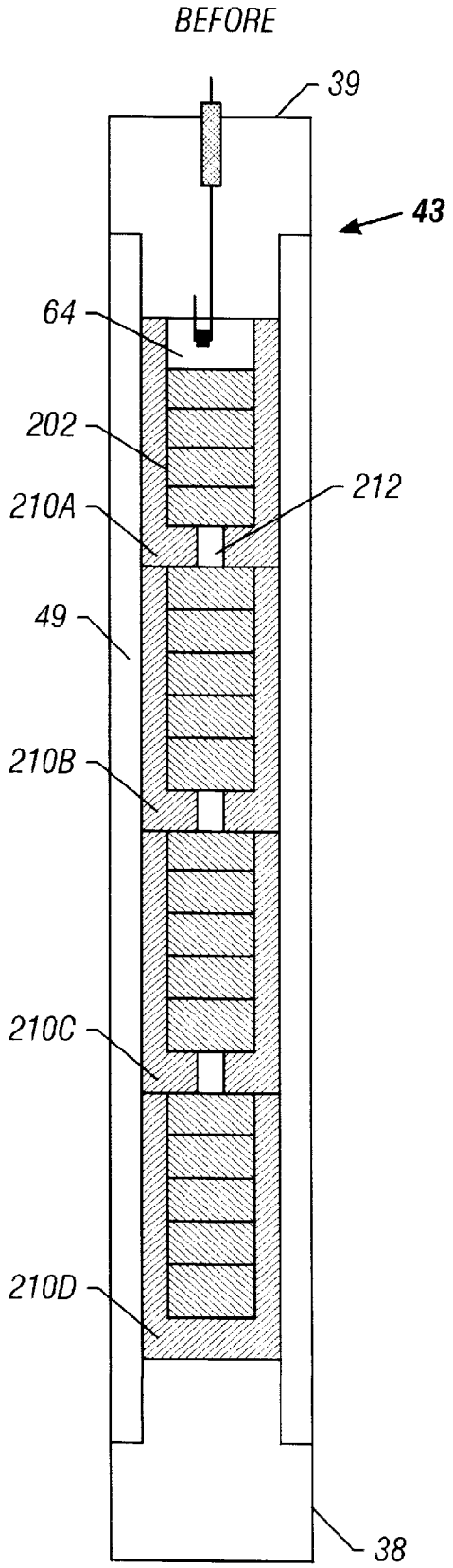
FIGS. 9A and 9B are diagrams of a zone isolation tool having a housing assembly for the energy source according to another embodiment of the invention.

The housing assembly used in the embodiment of FIGS. 7A and 7B may be adequate if the length of the housing assembly 43 is sufficiently short, e.g., one foot. In such a case, the non-uniform distribution of heat is not as pronounced. To reduce the hot spot temperature and to prevent the thermite reaction from burning or melting through the liner 71, a thermite mixture having a relatively low energy density can be selected Referring to FIGS. 9A and 9B, in another embodiment of the invention, instead of using a housing having a continuous inner cavity to store the local energy source, the energy source can be contained in multiple compartments 210A–D made using a thermal and chemical resistant material such as graphite or ceramics. The compartments are stacked generally along a vertical direction. Other arrangements of the compartments are possible. Although the illustrated embodiment has four compartments, any number of compartments can be used depending on the total length of the zone isolation tool and the length selected for each compartment. The compartments 210 can include graphite tubes (that can be, for example, 6 inches long each) inside the metal housing 49. Thermite pellets 202 can fill up each of the compartments 210.

To ignite the thermite in the first compartment 210A, the starter mix 64 is used. In the other compartments 210B–D, a small opening 212 is provided at the bottom face of each of the compartments 210A–C, but not in the bottom compartments 210D. The diameter of the hole on the bottom face is small, on the order of about 0.07 inches, for example. In the first compartment 210A, the reaction of the thermite after activation starts at the top and progresses downward. When the reaction reaches the bottom of the first graphite compartment 210A, some of the melted products of thermite are injected as a jet through the small opening 212 to ignite the thermite in the next compartment 210B. However, a large percentage of the molten products will be retained in the original compartment. This process is repeated as the reaction progresses down through the compartments until all the thermite in the housing assembly 43 has reacted. Thus, each of the compartments are effective for containing the melted products while at the same time the hole at the bottom of the compartment allow transfer of the thermite reaction. Some test results indicate that the compartments with a 0.07 inch hole can retain more than 85% of the molten products. The jet of molten injected through the hole tends to widen the holes somewhat.

By using multiple compartments to contain the thermite during reaction, a more uniform distribution of temperature along the length of the housing assembly 43 can be achieved. As a consequence, uniform distribution of heat to cure the permanent sleeve can be achieved while at the same time reducing the occurrence of "hot spots" that may damage the housing assembly 43.

Figure 9B:
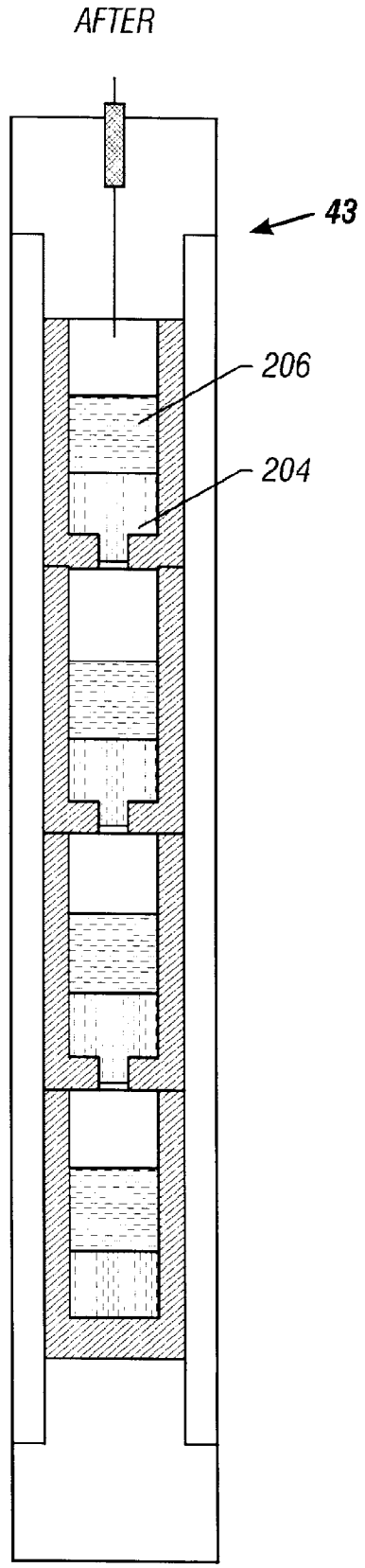

In FIG. 9B, during the reaction, the thermite forms a molten metal layer 204 and a metal oxide layer 206 on top of the metal layer 204 in each compartment 210. By using the compartments 210, concentration of the melted reaction products in the lower portion of the housing assembly inner cavity can be prevented.

Figure 10:
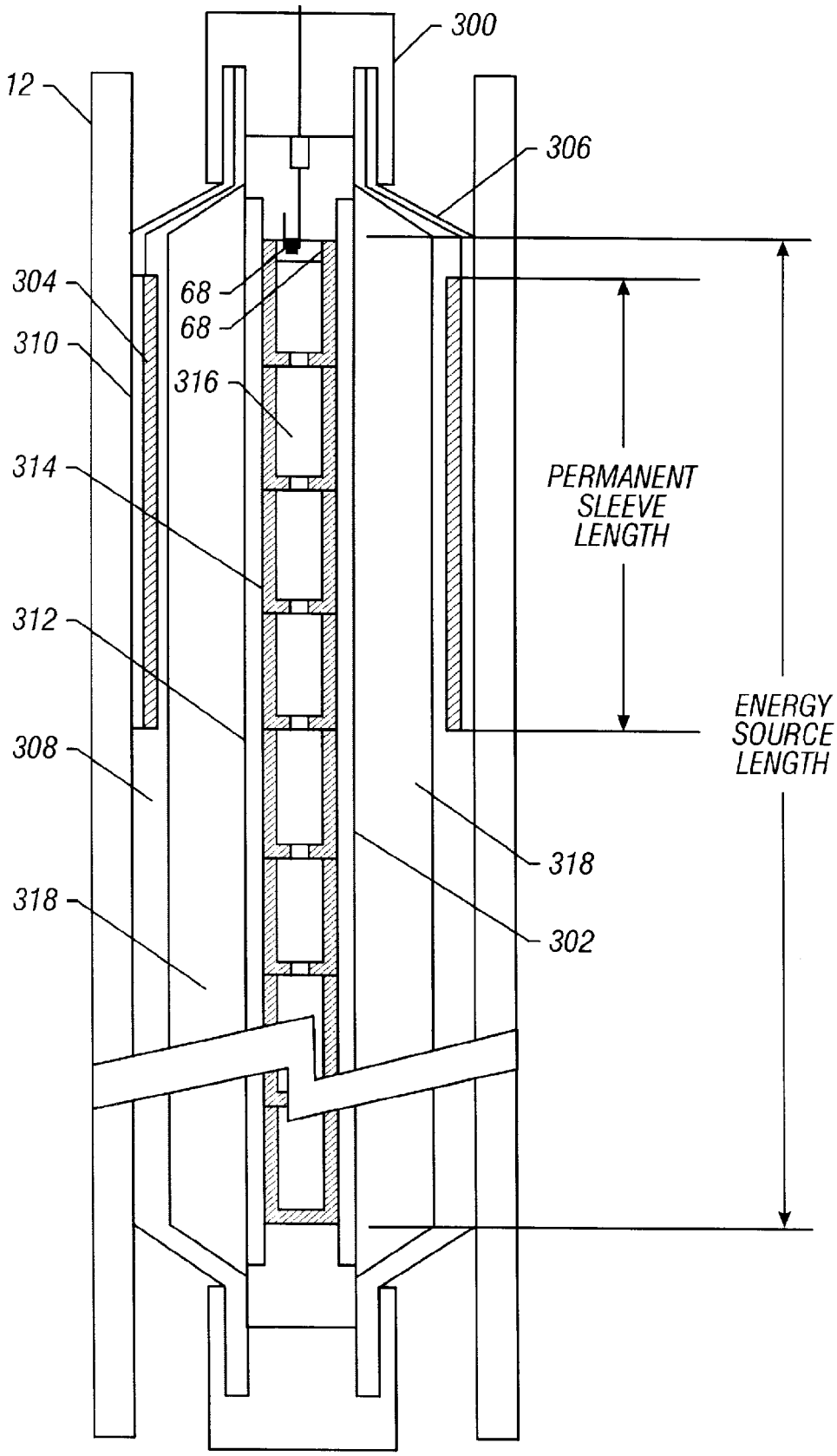
FIG. 10 is a diagram of a zone isolation tool of yet another embodiment of the invention.

Referring to FIG. 10, according to another embodiment of the invention, a zone isolation tool 300 has a local energy source container 302 that is longer than the permanent sleeve 304 (which includes epoxy, for example). In the sealing sleeve 306, an inflatable bladder 308 extends along the entire length of the zone isolation tool 300 while the permanent sleeve 304 and a sealing film 310 extend from near the top of the tool 300 and stop part of the way down the tool 300. In effect, the sealing sleeve 310 and permanent sleeve 304 are shorter in length than the inflatable bladder 308 and the tool 300. Inside the housing 312 of the tool 300 are multiple compartments 314 for storing an energy source 316 (e.g., thermite).

Thus, the length of the energy source is much greater than the length of the permanent sleeve 304. Due to convection, temperature stratification in the vertical direction (such as along the length of the tool if the tool is used in a generally vertical well) occurs inside space 318 (which can contain a liquid use to inflate the bladder 308). Hot liquid moves to the top to cause the temperature to be higher in the upper portion of the tool 300 than in the lower portion. To take advantage of this phenomenon, the energy source is made longer than the permanent sleeve 304, which is placed near the top of the tool. During the exothermic reaction of the energy source 316, transfer of heat energy is greatest in the upper portion of the tool 300, where the permanent sleeve 308 is positioned. As a result, efficiency of heat transfer can be increased.

The amount of heat generated by the exothermic reaction transfers by radiation and convection to the outer layers and typically elevates the temperature of the epoxy layer 40 to about 50° C. to 150° C. above the ambient temperature of the well 10 for a few hours. Such elevated temperatures for this length of time are sufficient to cure the resin and curing agent mixture in the epoxy sleeve 40 to transform the paste mixture into a hardened epoxy sleeve. Once the epoxy sleeve 40 is hardened, it remains fixed against the inside surface 52 of the casing section, and the elastomer film 42 acts as a seal to prevent fluid flow from the formation through the perforated openings 54 of the casing.

Figure 5:
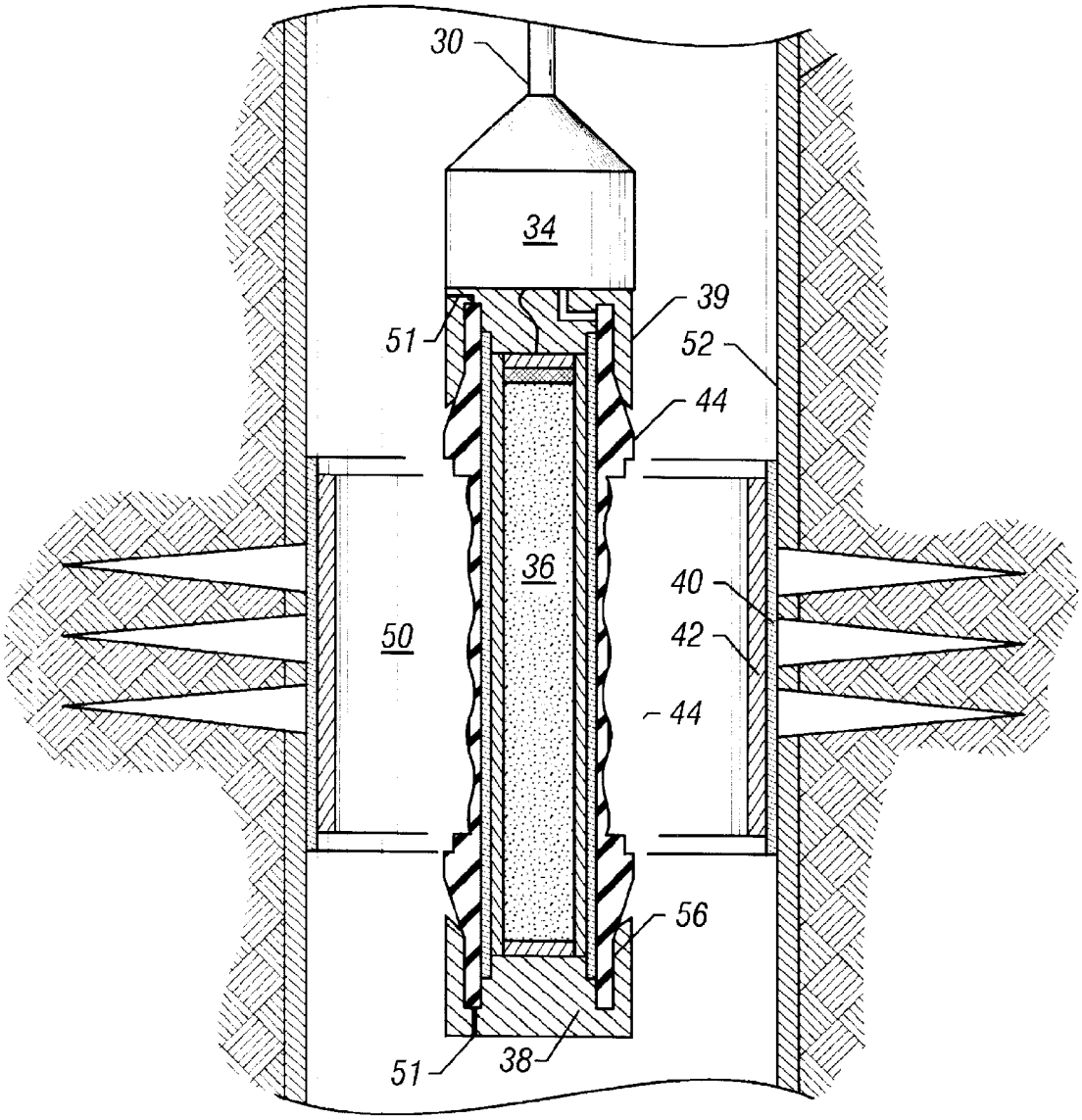
FIG. 5 is a diagram of a permanent sleeve layer of FIG. 2 after it has been cured and an inflatable sleeve layer which has been deflated after the curing process.

Referring to FIG. 5, once the epoxy layer 40 in the permanent sleeve has been cured, the pump in the tool head 34 discharges fluid from the bladder 44 to deflate the bladder. The deflated bladder 44 radially contracts and peels away from the epoxy sleeve 40. The carrying tool 32 can then be raised back through the production tubing 18 by the wireline or coiled tubing 30.

Figure 6A:
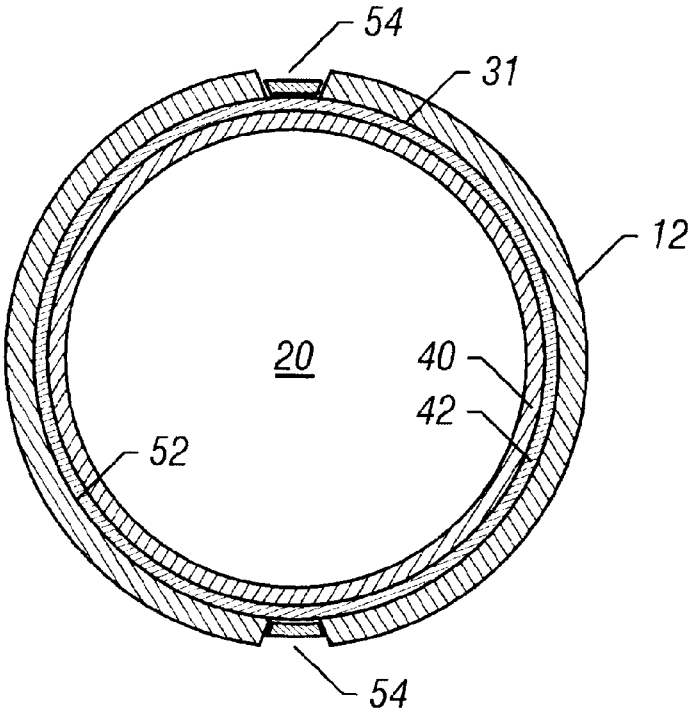
FIGS. 6A and 6B are cross-sectional diagrams of the permanent sleeve of FIG. 5 placed in the casing.
Figure 6B:
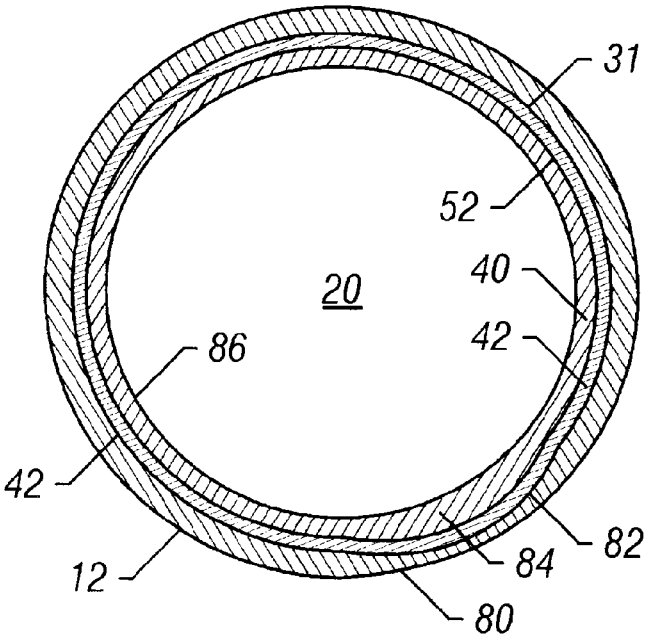

Referring to FIGS. 6A–6B, cross-sectional views of the permanent sleeve in place in the casing 12 show the epoxy sleeve 40, the elastomer film 42, and the casing 12. FIG. 6A shows the cross-sectional view of a casing having perforated holes 54. Because it has been cured under compression, the hardened epoxy sleeve 40 continues to press the elastomer film 42 against the inner wall 52 of the casing 12 and seals the perforated openings 54, preventing fluid flow from the surrounding formation through the perforated openings 54 to the casing bore 20. At the perforated holes 54, as a result of the compressive forces during curing, the elastomer film or sheet 42 partially extends into the holes 54, conforming to the hole edges, thereby improving the seal characteristics of the permanent sleeve at the edges of the holes.

In FIG. 6B, the casing 12 is shown with a defective portion 80, in which the casing wall is thinner than the rest of the casing. Such a defect can cause cracks or other openings to form in the casing wall such that fluid from the formation may leak into the well bore 20. The permanent sleeve also can be used to seal such a defective section in the casing 12. As shown in FIG. 6B, during the curing process, the section 84 of the epoxy sleeve 40 extends to conform to the shape of the casing wall. Although the outer surface of the epoxy sleeve 40 deforms to conform to the casing wall, the inner surface 86 of the epoxy sleeve 40 remains substantially cylindrical. The section 84 of the epoxy sleeve 40 presses the corresponding section of the elastomer film 82 against the defective portion 80 of the casing wall to prevent fluid from the surrounding formation leaking through cracks or other openings in the casing wall section 80.

The sealing sleeve described above can be used in many applications. One such application is the isolation of contaminants, such as water and/or sand, by sealing perforated sections of the casing. Another application is to completely or partially seal casing sections through which excessive gas is flowing from the surrounding formation, which can cause the pressure in the surrounding perforations to drop prematurely and adversely affect the producing characteristics of the well.

In another application, the sealing sleeve can be used to isolate zones in a horizontal well. Producing characteristics along the horizontal well can change over time. Thus, if a particular section of the horizontal well is no longer producing, that section can be isolated using the sealing sleeve to seal off the perforated openings of the casing in the horizontal well.

Another application of the sealing sleeve is to modify the injection profiles of a pay zone. For example, referring to FIG. 7, four wells 102, 104, 106 and 108 are drilled through a pay zone 100 to produce oil. If it is determined that pressure is inadequate for production purposes, the perforations of some of the wells can be sealed so that water or air can be pumped into the formation 10 below the pay zone 100 to increase the pressure at the producing wells. For example, perforations in the wells 102 and 108 adjacent the pay zone 100 can be sealed using sealing sleeves. Once sealed, water or air can be pumped down the wells 102 and 108 for injection at a lower level to increase the formation pressure for wells 104 and 106 and thereby improve production in the wells 104 and 106.

Other embodiments are also within the scope of the following claims. For example, other types of curing agents which when mixed with resin will achieve desirable curing temperatures can be used. A different exothermically reactive source other than thermite can be used to generate the required heat. Depending upon the temperatures achieved, the exothermically reactive source or other energy source may be incorporated as an inner or outer layer of the inflatable sleeve or as a layer within the substance of the internal sleeve. The layer in the permanent sleeve can contain a photosensitive material that is curable with a light source, and the downhole activatable energy source can produce light of appropriate curing wavelength, e.g., ultraviolet, instead of heat. The source of light may be outside of the inflatable sleeve, or the sleeve may be light-transmissive to enable light produced within the inflatable sleeve to reach the composite sleeve. Powered by a battery or a low power connection to the surface, the inflatable sleeve may comprise a bellows-like thermally-resistant metal sleeve. The inflatable sleeve may be inflated and deflated by a pump at the surface. The apparatus and method may be realized using multiple steps for positioning the composite sleeve, inflatable sleeve and local heat source.

While the invention has been disclosed with respect to a limited number of embodiments, those skilled in the art will appreciate numerous modifications and variations therefrom. It is intended that the appended claims cover all such modifications and variations as fall within the spirit and scope of the invention.

What is claimed is:

1. Apparatus for sealing an inner wall of a portion of a casing positioned in a well, comprising:

an inflatable sleeve having an outer surface;

a deformable composite sleeve of a curable composition extending around the outer surface of the inflatable sleeve, wherein the inflatable sleeve is inflatable to compress the composite sleeve against the surface of the inner casing wall; and a local activable energy source positioned downhole near the composite sleeve, the energy source being activatable to generate heat energy to cure the composite sleeve to form a hardened sleeve, wherein the hardened sleeve presses against the inner wall of the casing portion to create a fluid seal.

2. The apparatus of claim 1, wherein the composite sleeve includes a mixture of resin and a curing agent.

3. The apparatus of claim 2, wherein the mixture is curable to a hardened epoxy layer after exposure to the heat energy.

4. The apparatus of claim 1, wherein the local activable energy source includes an exothermic heat energy source.

5. The apparatus of claim 4, wherein the exothermic heat source includes thermite.

6. The apparatus of claim 5, wherein the thermite includes a composition having a metal oxide and a reductant.

7. The apparatus of claim 6, wherein the metal oxide is selected from a group consisting of $Fe_2O_3$, CuO, CoO, $Co_3O_4$, NiO, $Ni_2O_3$, and $PbO_2$.

8. The apparatus of claim 7, wherein the reductant is selected from a group consisting of Al, Si, Mg, Ti, and Ca.

9. The apparatus of claim 1, further comprising:

a starter mix positioned adjacent the local activable energy source, the starter mix being ignited to start an exothermic reaction in the heat energy source.

10. The apparatus of claim 1, wherein the local activable energy source is adapted to heat the composite sleeve to greater than about 50° C. above the ambient temperature of the well.

11. The apparatus of claim 1, further comprising:

a carrying tool for carrying the inflatable sleeve, the composite sleeve, and the energy source down the well to the casing portion.

12. The apparatus of claim 11, wherein the well includes a production tubing having a first diameter, and wherein the carrying tool has a second diameter less than the first diameter to allow the carrying tool to be lowered down the production tubing.

13. The apparatus of claim 11, wherein the carrying tool further includes means for inflating the inflatable sleeve, and wherein the local activable energy source is an exothermic heat energy source mounted centrally within the tool and means to inflate the inflatable sleeve that enables heat transfer from the energy source to the inflatable sleeve.

14. The apparatus of claim 1, further comprising:

a conformable layer extending around the composite sleeve, the layer acting to form a seal between the composite sleeve and the inner wall of the casing portion.

15. The apparatus of claim 1, further comprising a unitary downhole tool including an assembly of the inflatable sleeve, the composite sleeve and the local activable energy source positioned to provide curing heat to the composite sleeve.

16. A method of sealing an inner wall of a portion of a casing in a well, comprising:

lowering as assembly of an inflatable sleeve, a composite, curable sleeve, and a heat source down to the casing portion using a carrying tool;

positioning the inflatable sleeve having an outer surface down the well at the portion of the casing, the composite, curable sleeve extending around the outside of the inflatable sleeve;

inflating the inflatable sleeve to compress the composite sleeve against the surface of the inner casing wall; and activating the heat source to cure the composite sleeve to form a hardened sleeve, wherein the hardened sleeve presses against the inner wall of the casing portion to create a fluid seal.

17. The method of claim 16, wherein the well includes a production tubing, the method further comprising lowering the assembly through the production tubing to the casing section.

18. The method of claim 16, wherein the heat source includes an exothermic heat energy source for generating heat energy to cure the composite sleeve.

19. The method of claim 18, wherein the composite sleeve includes a mixture of resin and a curing agent.

20. The method of claim 18, further comprising:

curing the mixture to a hardened layer after exposure to the heat.

21. The method of claim 16, wherein the heat source includes thermite.

22. The method of claim 16, further comprising:

igniting a starter mix positioned adjacent the heat source to initiate an exothermic reaction in the heat source.

23. The method of claim 16, further comprising:

using the heat source to increase the temperature to greater than 50° C. above the ambient temperature of the well.

24. The method of claim 16, wherein a conformable layer extends around the composite sleeve, the layer acting to form a seal between the composite sleeve and the inner wall of the casing section.

25. A downhole tool, comprising:

a composite layer of a curable composition; and an exothermic heat energy source activated to generate heat to cure the composite layer.

26. The downhole tool, of claim 25, wherein the exothermic heat source includes an exothermic pyrotechnic energy source.

27. The downhole tool of claim 25, wherein the exothermic heat source includes thermite.

28. The downhole tool of claim 25, further comprising a housing to contain the exothermic heat energy source.

29. The downhole tool of claim 28, wherein the housing includes an inner heat resistant liner placed between the exothermic energy source and the housing.

30. The downhole tool of claim 29, wherein the liner includes graphite.

31. The downhole tool of claim 29, wherein the liner includes ceramic.

32. The downhole tool of claim 29, wherein the liner is also resistant to chemical reaction.

33. The downhole tool of claim 28, wherein the housing further comprises compartments each containing a respective portion of the local heat source.

34. The downhole tool of claim 33, wherein each compartment is made of a heat resistant material.

35. The downhole of claim 34, wherein the heat resistant material includes graphite.

36. The downhole tool of claim 34, wherein the heat resistant material includes ceramics.

37. The downhole tool of claim 33, wherein the exothermic heat energy source includes pellets of thermite.

38. The downhole tool of claim 33, wherein small openings are provided in at least some of the compartments to allow transmission of energy from one compartment to an adjacent compartment for activating the heat source of the adjacent compartment.

39. The downhole tool of claim 38, wherein the compartments are stacked generally along the length of the tool.

40. Apparatus for use in a wellbore, comprising:

a composite layer of a curable composition;

a housing to store a local activable heat source, the housing including compartments that separately store respective portions of the local activable heat source.

41. The apparatus of claim 40, wherein the local activable heat source includes an exothermic heat source.

42. The apparatus of claim 40, wherein the local activable heat source includes a gasless, pyrotechnic energy source.

43. The apparatus of claim 40, wherein the local activable heat source includes thermite.

44. The apparatus of claim 40, wherein the compartments are each made of a heat resistant material.

45. The apparatus of claim 44, wherein the heat resistant material includes ceramics.

46. The apparatus of claim 44, wherein the heat resistant material includes graphite.

47. The apparatus of claim 40, wherein at least some of the compartments include openings to allow energy to be transmitted from one compartment to an adjacent compartment to activate the heat source in the adjacent compartment.

48. A zone isolation tool, comprising:

a housing that contains an exothermic heat source, the housing having an upper end and a first length; and a composite sleeve of an curable composition positioned around the housing near the upper end, the composite sleeve having a length smaller than the first length of the housing, the exothermic source activable to generate heat to cure the composite sleeve.

* * * * *